United States Patent [19]

de Koning et al.

[11] 4,177,585

[45] Dec. 11, 1979

[54] METHOD AND APPARATUS FOR DREDGING

[75] Inventors: Jan de Koning, Amsterdam; Jan Steyn, Nieuw-Vennep, both of Netherlands;

[73] Assignees: Ballast-Nedam Groep N.V., Amsterdamse Ballast Bagger en Grond (Amsterdam Ballast Dredging) B.V., Amstelveen; Scheepswerf en Machinefabriek "De Liesbosch" B.V., Nieuwegein, both of Netherlands

[21] Appl. No.: 876,173

[22] Filed: Feb. 8, 1978

[51] Int. Cl.[2] ..... E02F 3/90

[52] U.S. Cl. ..... 37/67; 37/195; 37/DIG. 1; 37/DIG. 19; 114/230

[58] Field of Search ..... 37/54, 58, 67, 65, 66, 37/64, 72, 73, 195, DIG. 19, DIG. 1; 114/230

[56] References Cited

U.S. PATENT DOCUMENTS

| | | | |
|---|---|---|---|
| 2,242,520 | 5/1941 | Grundborg | 37/67 |
| 2,361,404 | 10/1944 | Kalix | 37/67 |
| 3,350,798 | 11/1967 | Nelson | 37/65 |
| 4,084,334 | 4/1978 | Wolters et al. | 37/67 |

FOREIGN PATENT DOCUMENTS

| | | | |
|---|---|---|---|
| 6918088 | 6/1971 | Netherlands | 37/58 |

*Primary Examiner*—Clifford D. Crowder
*Attorney, Agent, or Firm*—John P. Snyder

[57] ABSTRACT

In order to accurately control the cutter head of a cutter head suction dredger anchored by means of ropes, the tension in at least one of the two longitudinal ropes is measured and the winch of at least one of the two longitudinal ropes is actuated in dependence upon the tension measured in the one longitudinal rope.

10 Claims, 7 Drawing Figures

Figure 1:
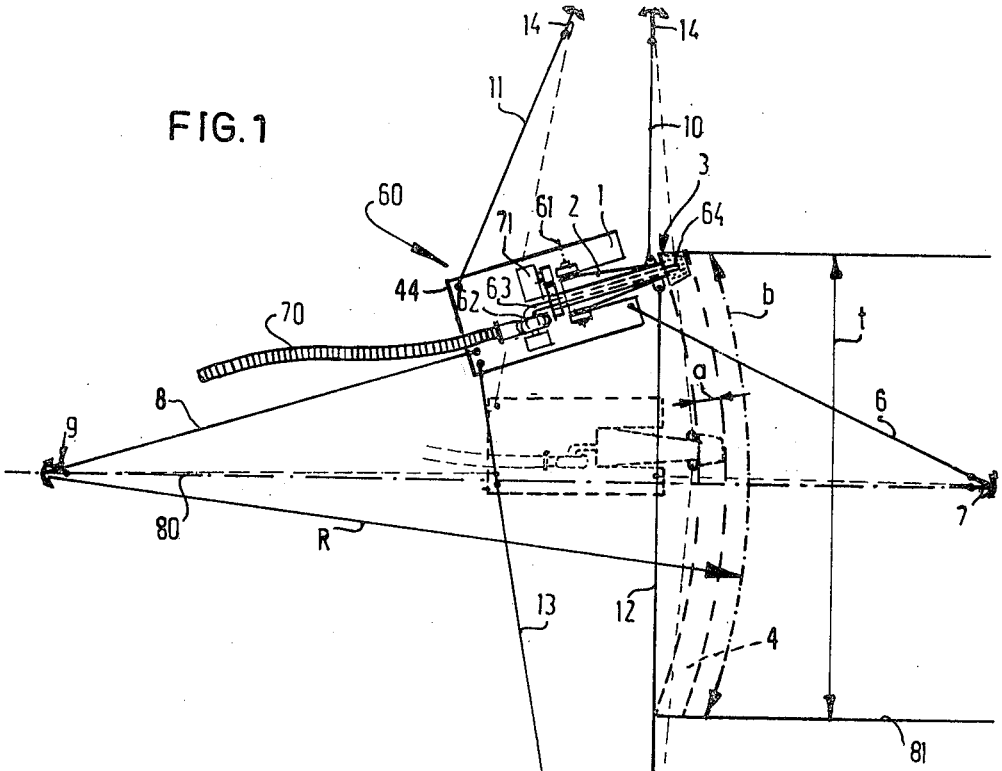

FIG.6
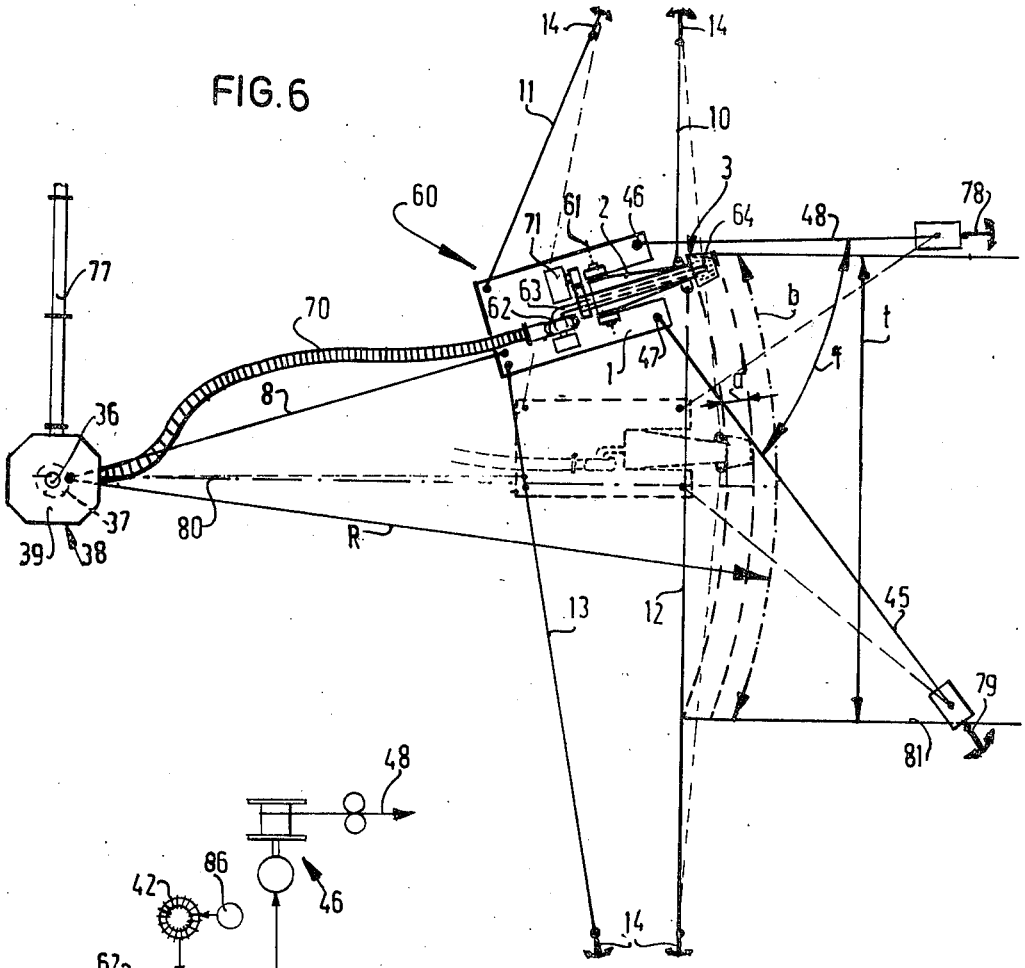
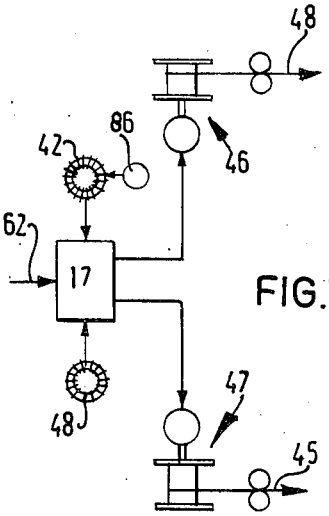
FIG.7

METHOD AND APPARATUS FOR DREDGING

The invention relates to a method of dredging with the aid of a cutter head suction dredger in which a cutter head having a suction nozzle and loosening the ground is level-variably connected with a floating body, which is moved in a reciprocatory manner by means of side ropes emanating from winches both on the port side and the starboard side of the cutter head dredger and being anchored to the ground along a trajectory, the lateral reciprocatory movement of the floating body being guided in that the floating body is, in addition, retained by means of at least one longitudinal rope emanating from a winch at the bow of the floating body and being anchored to the ground and at least one longitudinal rope emanating from a winch on the rear side of the floating body and being anchored to the ground, the longitudinal ropes being turned about their anchoring means during the reciprocatory movement and in which the displacement of the floating body in the direction of length with respect to the ground is regulated by veering out one longitudinal rope and hauling in the other or conversely.

Such a method is known from U.S. Pat. No. 3,350,798.

A disadvantage of this known method resides in that the cutter head cannot be accurately controlled due to the undefined sagging and extension of the longitudinal cables. Since during the reciprocatory movement an optimal, fixed start of the cutter head is important for an efficient dredging operation, anchoring of the cutter head suction dredger by means of cables during operation has hardly been carried out in practice. Hitherto a cutter head dredger has mainly been anchored by means of a spud pile because of the fixed connection between the cutter head and the fixed anchoring spot of the spud pile, although in deep water dredging the construction of the spud pile has to be very heavy, dredging in a moving sea by means of spud pile anchorage requires an expensive, level-variable joint between the floating body and the spud pile and the reciprocatory movement is limited by the comparatively short radius of turn about the spud pile, so that the dredging operation frequently has to be interrupted for displacing the spud pile.

The invention has for its object to improve the control of the cutter head and to reduce the number of interruptions of the dredging process.

To this end the method according to the invention is characterized in that the tension in at least one of the two longitudinal ropes is measured and the winch of at least one of the two longitudinal ropes is actuated in dependence upon the tension measured in the one longitudinal rope.

The invention furthermore relates to and provides an improvement in a cutter head suction dredger for carrying out the method embodying the invention, said dredger comprising at least a floating body, a cutter head level-variably connected with the floating body, a pump, a suction nozzle communicating through a suction pipe with the pump and arranged near the cutter head, side ropes emanating from winches both on the port side and the starboard side of the cutter head dredger and having to be anchored to the ground, at least one longitudinal rope emanating from a winch at the bow of the floating body and having to be anchored to the ground and at least one longitudinal rope emanating from a winch on the rear side of the floating body and having to be anchored to the ground, said dredger being characterized by a tension meter for measuring the tension of at least one of the two longitudinal ropes and by control-means of at least one winch of a longitudinal rope acting in dependence upon the measuring results of the extensometer.

The above-mentioned and further features of the invention will be set out in the following description with reference to a drawing.

In the drawing there show schematically

Figure 2:
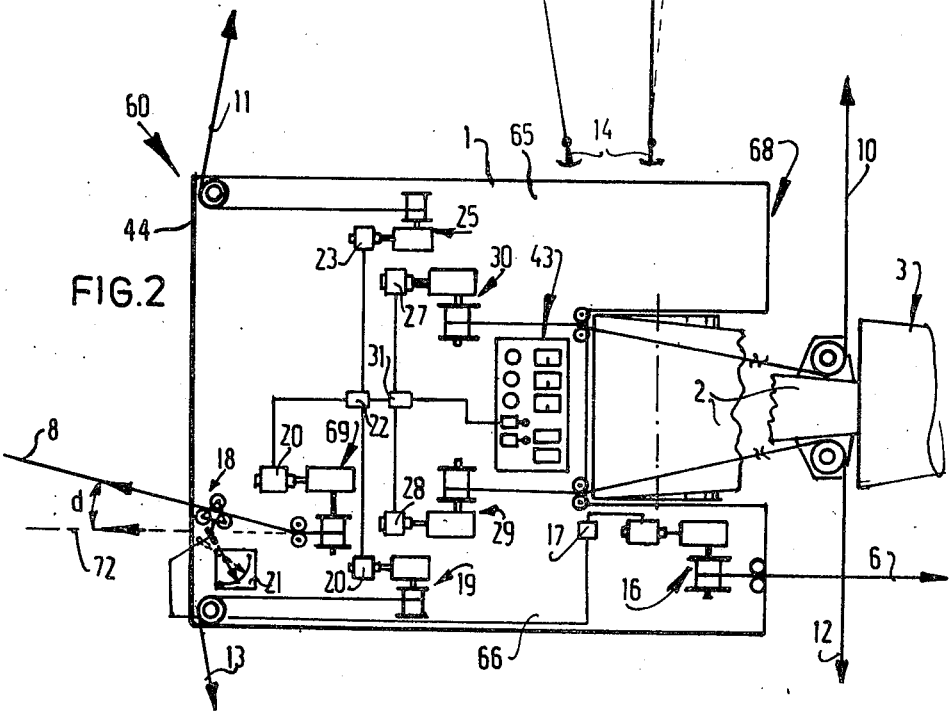
Figure 3:
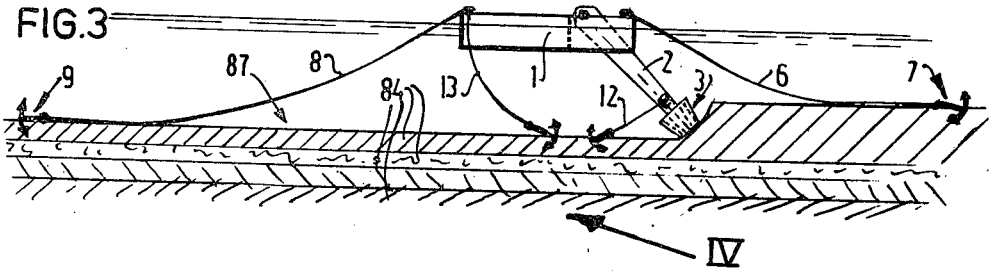
Figure 4:
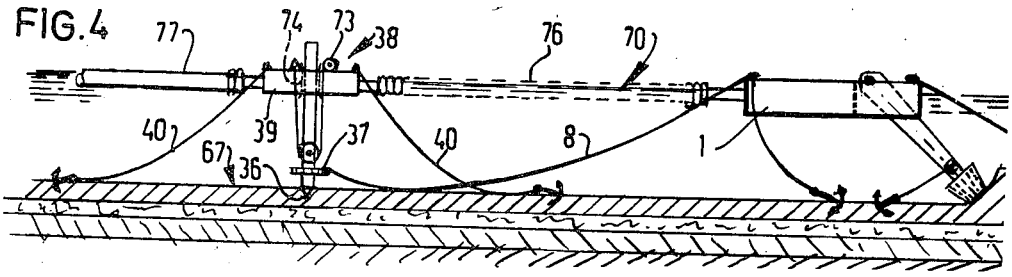
Figure 5:
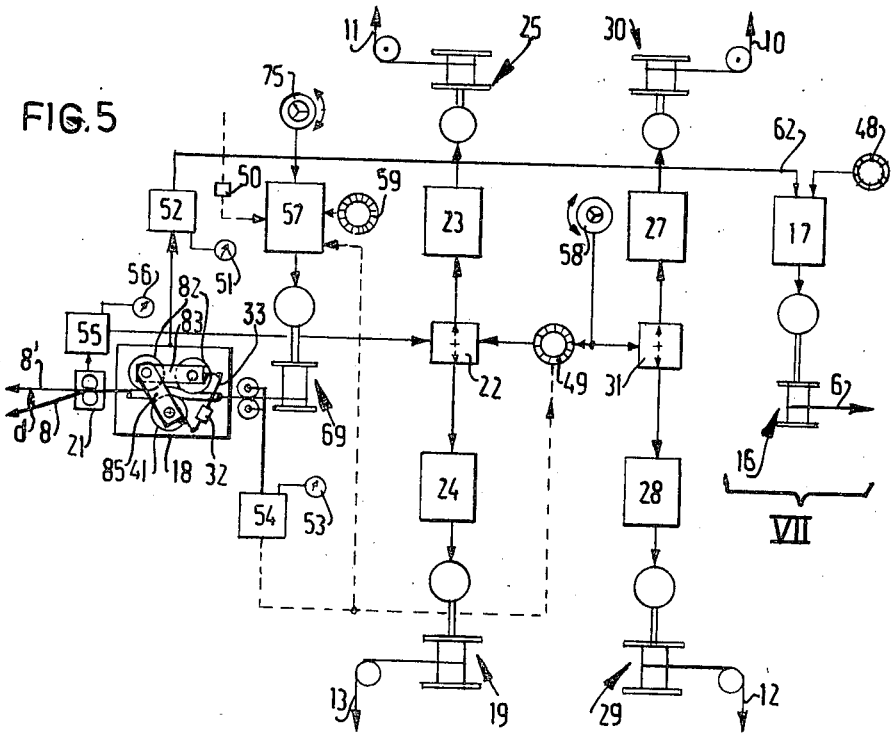

FIG. 1 a plan view of a preferred embodiment of the cutter head suction dredger in accordance with the invention, FIG. 2 is an enlarged view of the dredger of FIG. 1, FIG. 3 is a side elevation of the cutter head suction dredger of FIG. 1, FIG. 4 a variant of the detail IV of FIG. 3, FIG. 5 a schematic survey of the winch control-means of the cutter head suction dredger of FIG. 1, FIG. 6 a plan view of a further development of the cutter head suction dredger in accordance with the invention, and FIG. 7 a variant of the detail VII of FIG. 5 for the cutter head suction dredger of FIG. 6.

The cutter head suction dredger 60 shown in FIGS. 1 to 3 for carrying out the method embodying the invention comprises a floating body 1, a cutter head 3 level-variably connected with the floating body 1 and being rotatably driven by a motor 71 and supported by a ladder 2 connected with the floating body 1 so as to be pivotable about a horizontal axis 61, a pump 62, a suction nozzle 64 communicating through a suction tube 63 with the pump 62 and arranged near the cutter head 3, a floating pressure pipe 70 communicating with the pump 62, side ropes 10, 12, 11 and 13 respectively emanating from winches 30, 29 and 25, 19 both on port and starboard side 65 and 66 respectively of the cutter head suction dredger 60 and having to be anchored to the ground 67, a longitudinal rope 6 emanating from a bow winch 16 at the bow 68 of the floating body 1 and having to be anchored to the ground 67, termed "bow rope" 6 hereinafter, and a longitudinal rope 8 emanating from a winch 69 on the rear side 44 of the floating body 1 and having to be anchored to the ground 67, termed "rear rope" 8 hereinafter. Said side ropes 10, 12, 11 and 13 are anchored to the ground 67 by means of anchors 14 and the longitudinal ropes 6 and 8 by means of anchors 7 and 9 respectively. According to the invention the cutter head suction dredger 60 is characterized by a tension meter 18 arranged on the rear rope 8 for measuring the tension of said rear rope 8 and by control-means 17 of the bow winch 16 of the bow rope 6 governed by said tension meter 18.

From FIG. 1 it will be apparent that the cutter head dredger 60 is reciprocated along a path b over a cutting depth a by means of the side ropes 10, 11, 12 and 13. The floating body 1 then swings around the anchor 9 of the rear rope 8. The broken lines show the cutter head dredger 60 in a different position turned with respect to the anchor 9.

FIG. 2 shows in further detail the control-scheme for the winches 16, 69, 30, 29, 25 and 19.

In the method according to the invention the bow rope 6 is veered out or hauled in in dependence upon the tension measured by the tension meter 18 in order to ensure that the cutter head dredger 60 is turned through an arc b, the centre of which is formed by the anchor 9 and the radius R of which is constant, with respect to the rear rope 8 held at the same or substantially the same length. When the radius R of the swinging movement is progressively raised by a value a, the cutting depth is equal or substantially equal to said value a, which is of great importance for the optimum operation of the cutter head dredger 60.

From a control-panel 43 actuating signals are applied through a control-device 31 to control-members 27 and 28 of the foremost side-rope winches 29 and 30 by hauling in and veering out the side ropes 12, 10 respectively so that they cause the cutter head 3 to move along the trajectory b. Through a computing device 22 the control-device 31 applies signals to the control-members 23, 24 of the hindmost side-rope winches 25 and 19 for hauling in and veering out the side ropes 11 and 13. In accordance with the positions of the ropes 10, 11, 12 and 13 there is in general applied a lower control-voltage so that the winches 25 and 19 haul in and veer out respectively a proportionally smaller length of rope than the winches 29 and 30 as a result of the difference in distances of the side ropes 10, 12 and of the side ropes 11, 13 from the anchor 9. An angle meter 21 measures an angle d between a plane 72 of the floating body 1 and the rear rope 8, said measuring value being applied to the computing device 22. Since the rear rope 8 has to be held most closely to the plane 72, the signal of the measured angle d is combined in the computing device 22 with the signal from the control-device 31 in order to govern the control-members 23 and 20 of the winches 25 and 19 associated with the hindmost side ropes 11 and 13 so that the rear rope 8 is invariably held in or substantially in the adjusted plane 72.

Referring to the side elevation of FIG. 3, the anchor 9 is arranged at a comparatively large distance from the floating body 1. The rope 8 is thus subjected to such a high tension that the chain line between the floating body 1 and the anchor 9 guarantees such sagging of the rope that the rope does not or will hardly touch the ground. The same measures are applied to the other ropes 6, 10, 11, 12 and 13, so that also their extension is limited and accurate positioning is possible.

The detail of FIG. 4 illustrates anchoring means 38 comprising a pontoon 39 linked to the ground 67 by means of anchoring ropes 40 and holding a fall pole 36 in the ground 67, said pole 36 being provided at a low level with a fastening ring 37 for the rope 8. The fall pole 36 can be elevated by means of a lifting device 73 whilst being guided vertically in a guide tube 74. The pressure pipe 70 preferably extends via the pontoon 39 to its intended place of action (not shown) and the pipe portion 76 between the cutter head suction dredger 60 and the pontoon 39 is very flexible, whereas the portion 77 located after the pontoon 39 may be substantially rigid.

If the method embodying the invention has to be employed for dredging a channel 81 having a width t (FIG. 1), the anchors 14, 7 and 9 are put in place, the anchors 7 and 9 being arranged substantially in the longitudinal central plane 80 of the channel 81 and the anchors 14 at the side of the cutter head dredger 60. The cutter head dredger 60 is put in a starting position in the longitudinal central plane 80, after which the ropes 6, 8, 10, 11, 12 and 13 are stretched to their predetermined tensions as well as the side ropes 10, 11, 12 and 13 being stretched by means of their winches 19, 25, 19 and 30 and the rear rope 8 by means of the bow rope 6. The cutter head dredger 60 is then moved into its working position shown in solid lines in FIG. 1 and after lowering the ladder 2 with the cutter head 3 to the predetermined depth it is ready to make the first cut 4. The ropes 10 and 11 are then slowly veered out, whereas the ropes 12 and 13 are hauled in with a rate imposed by the nature of the soil 67 to be loosened on the cutter head dredger 60. During the complete swing the tension of the rear rope 8 is maintained at a constant value by being measured by the tension meter 18. The measured value amplified in an amplifier 52 is enunciated by an indicator 51 on the control-panel 43 and the amplified measured value is applied through a lead 62 to the control-member 17, which delivers a control-signal to the bow winch 16 after comparison with a tension of the rear rope 8 adjusted by setting means 48. The signal delivered by a control-member 58 to the control-device 31 of the foremost side rope winches 29 and 30 produces a signal at the control-member 28 of the foremost side winch to haul in the rope 12 and at the control-member 27 of the foremost side winch for veering out the rope 10 from the winch 30, whilst a residual tension is maintained. The signal of the control-member 58 on the panel 43 is furthermore applied to the adaptor 49 of the hauling rate of the hindmost side rope winches 25 and 19, said signal being applied to the computing device 22 of the hindmost side rope winches 25 and 19, to which computer 22 is furthermore applied the signal of the angle meter 21 amplified by the amplifier 55. In dependence upon the position of the lever 56 of the angle meter 21 the signals emanating from the computer 22 are applied to the control-member 20 of the winch 19 for hauling in, so that the rear end 44 of the cutter head dredger 60 shifts to the right at the correct rate and to the control-member 23 of the hindmost side rope winch 25, so that the latter veers out the rope 11 with the predetermined residual tension. After a cut 4 is completely dredged away, the cutter head dredger 60 has to be advanced by a cut depth a, which is preformed by adjusting a setting member 59 on the control-panel 43 to the length a. The signal of the setting member 59 is applied to the control-member 57 of the rear winch 69, which is energized with the aid of a switching knob 50 to veer out the rope 8 over the length a. Owing to the disappearance of the tension of the rear rope 8, which is measured by the tension meter 18, the result being passed through the amplifier 52 to the control-member 17 of the bow winch 16, the latter is immediately actuated so that the adjusted tension of the rear rope 8 is regained. The control-member 17 can respond so rapidly that upon veering out the rear rope 8 the bow rope 6 is immediately hauled in in order to maintain a constant tension in the rear rope 8. The winch 69 delivers, in addition, a signal corresponding to the length of the rear rope 8 through an amplifier 54 to an indicator 53 and to the control-member 49 of the hindmost side winches 25 and 19. As soon as the rear rope 8 has reached such a length that swinging about the anchor 9 is no longer possible without the rope dragging along the ground 67 over a considerable length, the cutter head dredger 60 has to be anchored by means of the anchors 14, 7 and 9 being arranged at new places.

The setting member 75 then actuates the winch 69 of the rear rope 8. Then the cutter head dredger 60 is moved into a new starting position.

With the aid of the cutter head dredger 60 according to the invention the ground 67 can, so to say, be peeled off in horizontal layers 84 (FIG. 3), the cutter head 3 being constantly held at the same level in a given layer.

In this way dredging can be carried out with high efficiency.

In order to avoid overload of the bow rope 6 during the swinging movement of the cutter head dredger a preferred embodiment of the cutter head dredger 60 as shown in FIG. 6 comprises two bow ropes 48 and 45 at an acute angle f to one another with the associated winches 46 and 47 and the associated, relatively spaced anchors 78 and 79 rather than one bow rope 6.

If two bow ropes 48 and 45 (FIG. 6) are provided, the detail VII of FIG. 5 has the structure shown in FIG. 7. The control-member 17 of FIG. 7 is, in addition influenced by a deflection-signal generator 42 of a compass 86, the control-member 17 governing the winches 46 and 47.

The tension meter 18 comprises, for example, two guide rollers 82 in a frame 83 and an auxiliary frame 85 adapted to pivot with respect to the frame 83 and holding a guide roller 41. The auxiliary frame 85 is linked to the frame 83 through a tensile rod 33 provided with tension measuring members 32, for example, strain gauges.

What we claim is:

1. The method of dredging which comprises the steps of:

(a) moving a floating body laterally, while dredging material with a dredging head carried by the body, by anchoring side ropes at points laterally spaced from and on opposite sides of said body and hauling in one of said side ropes while paying out the other, whereby the dredger head traverses a dredging path;

(b) locating said body longitudinally during step (a) by a longitudinal rope connected with the rear of the body and anchored at a point spaced rearwardly from the body and by at least one further longitudinal rope connected with the bow of the body and anchored at a point spaced forwardly from the body, and applying tension to said longitudinal ropes; and (c) controlling said dredging path to follow a predetermined path by sensing the tension in one of said longitudinal ropes and maintaining the sensed tension at a predetermined value during the lateral movement of the body in step (b).

2. The method of dredging as defined in claim 1 wherein said predetermined value of tension in step (c) is the same as the tension applied in step (b).

3. The method of dredging as defined in claim 2 including the steps, subsequent to step (c), of (d) advancing said body by the width of said dredging path; (e) moving said body laterally, opposite to the direction of movement of step (a), by hauling in said other side rope while paying out said one side rope; and (f) controlling the dredging path, as in step (c), during step (e).

4. The method of dredging as defined in claim 1 wherein the tension is maintained in step (c) by actuating a winch upon which a longitudinal rope is wound.

5. The method as defined in claim 1 wherein tension is sensed in said one longitudinal rope and the tension of step (c) is maintained by actuating a winch upon which said other longitudinal rope is wound.

6. The method as defined in claim 1 including the step of sensing the angular disposition of the longitudinal axis of said body with respect to a longitudinal rope and, during step (a), maintaining said angularity as the body is moved laterally.

7. The method of dredging, which comprises the steps of:

(a) locating a floating body longitudinally by a longitudinal rope connected with the rear of the body and anchored at a point spaced rearwardly from the body and by at least one further longitudinal rope connected with the bow of the body and anchored at a point spaced forwardly from the body, and applying tension to said longitudinal ropes;

(b) moving said body laterally, which dredging material with a dredging head carried by the body, by differentially hauling in two side ropes at longitudinally spaced positions on one side of the body and which side ropes are anchored at points laterally spaced from one side, while differentially paying out a further two side ropes at longitudinally spaced positions on the opposite side of the body and which further side ropes are anchored at points laterally spaced from said opposite side, the differentially hauling and paying out being effective to maintain a substantially fixed angularity between said body and one of said longitudinal ropes; and (c) controlling said dredging path to follow a predetermined path by sensing the tension in one of said longitudinal ropes and maintaining the sensed tension at a predetermined value during the laterial movement of the body in step (b).

8. A suction dredger comprising, in combination:

a floating body having a dredging head carried thereby for disposition at different levels below said body;

a bow winch and a stern winch carried by said body, each having a longitudinal rope wound thereon, and means for anchoring said longitudinal ropes respectively ahead of and behind said body;

a pair of side winches carried by said body at opposite sides thereof, each having a side rope wound thereon, and means for anchoring said said ropes respectively at points remote from said opposite sides of the body;

first control means for actuating said side winches to pay out one of said side ropes while hauling in the other whereby to displace said body laterally;

sensing means for sensing the tension in one of said longitudinal ropes; and second control means actuated by said sensing means for maintaining constant tension in one of said longitudinal ropes.

9. A suction dredger as defined in claim 8 wherein said second control means actuates the winch of the other longitudinal rope.

10. A suction dredger as defined in claim 8 including a second pair of side winches having second side ropes wound thereon and means for anchoring said second side ropes at points remote from said opposite sides of the body; means for sensing the angularity of one longitudinal rope with respect to the longitudinal axis of said body; and means for causing said first control means differentially to actuate said side winches to preserve said angularity.

* * * * *